US005769802A

United States Patent [19]

Wang

[11] Patent Number: 5,769,802

[45] Date of Patent: Jun. 23, 1998

[54] WATER ACTUATED BATH BRUSH

[76] Inventor: Shareif Wang, 5095 Napilihau St. #315, Lahaina, Hi. 96761

[21] Appl. No.: 680,134

[22] Filed: Jul. 15, 1996

[51] Int. Cl.[6] ..... A61H 9/00

[52] U.S. Cl. ..... 601/160; 601/114

[58] Field of Search ..... 601/160, 114

[56] References Cited

U.S. PATENT DOCUMENTS 3,802,422 4/1974 Hurst ..... 601/160

4,471,503 9/1984 Smyth ..... 601/160 X 5,385,532 1/1995 Shyu ..... 601/160

*Primary Examiner*—William H. Grieb

*Attorney, Agent, or Firm*—Michael I. Kroll

[57] ABSTRACT

A water actuated bath brush (10) comprises a facility (12) for cleaning the skin of a person. A structure (14) is for converting kinetic energy of moving water to mechanical power to operate skin cleaning facility (12) and soap from soap dish (68) facilitates a combination of soap and water to be easily applied to a person's skin.

20 Claims, 4 Drawing Sheets

WATER ACTUATED BATH BRUSH

BACKGROUND OF THE INVENTION

1. Field of the Invention

The instant invention relates generally to bath accessories and more specifically it relates to a water actuated bath brush having means to automatically inject soap into a water stream which then is applied automatically by rotating brushes onto a person's skin.

2. Description of the Prior Art

Numerous bath accessories have been provided in prior art that are adapted to be utilized by persons when using a bathtub or shower for washing the body. While these units may be suitable for the particular purpose to which they address, they would not be as suitable for the purposes of the present invention as heretofore described.

SUMMARY OF THE INVENTION

A primary object of the present invention is to provide a water actuated bath brush that will overcome the shortcomings of the prior art devices.

Another object is to provide a water actuated bath brush that utilizes water pressure from a flexible hose connected to a diverter valve at a shower head, so as to drive a plurality of rotary brushes in a safe manner.

An additional object is to provide a water actuated bath brush that contains narrow tubing within a housing connected to the flexible hose, which will increase the water pressure to make turbines therein rotate faster and increase the scrubbing ability of the rotary brushes for better cleaning the skin of a person.

A still further object is to provide a means to incorporate soap into a water stream so that the resulting solution is applied to a person's skin by means of rotating brushes.

A further object is to provide a water actuated bath brush that is simple and easy to use.

A still further object is to provide a water actuated bath brush that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 5:
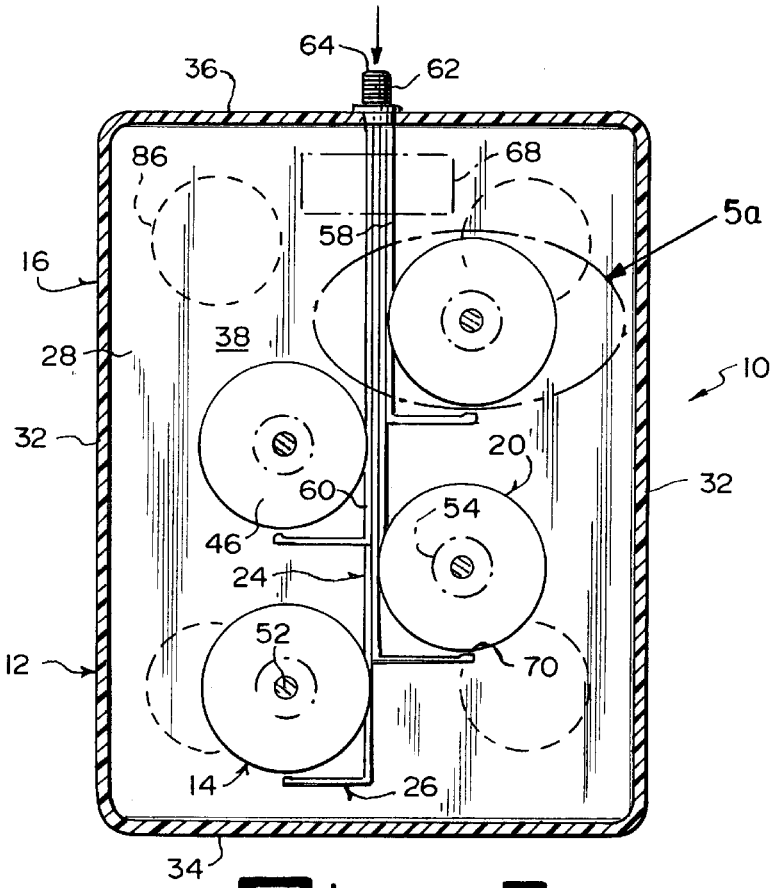
FIG. 5 is a diagrammatic cross sectional view taken along line 5—5 in FIG. 3.
Figure 5A:
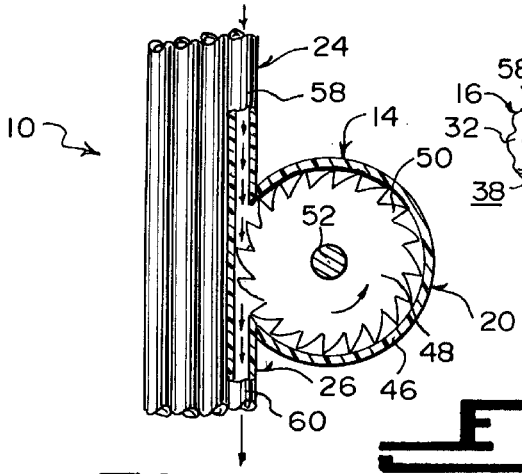

FIG. 5*a* is an enlarged detail view with parts broken away and in section, as indicated by arrow 5*a* in FIG. 5.

Figure 1:
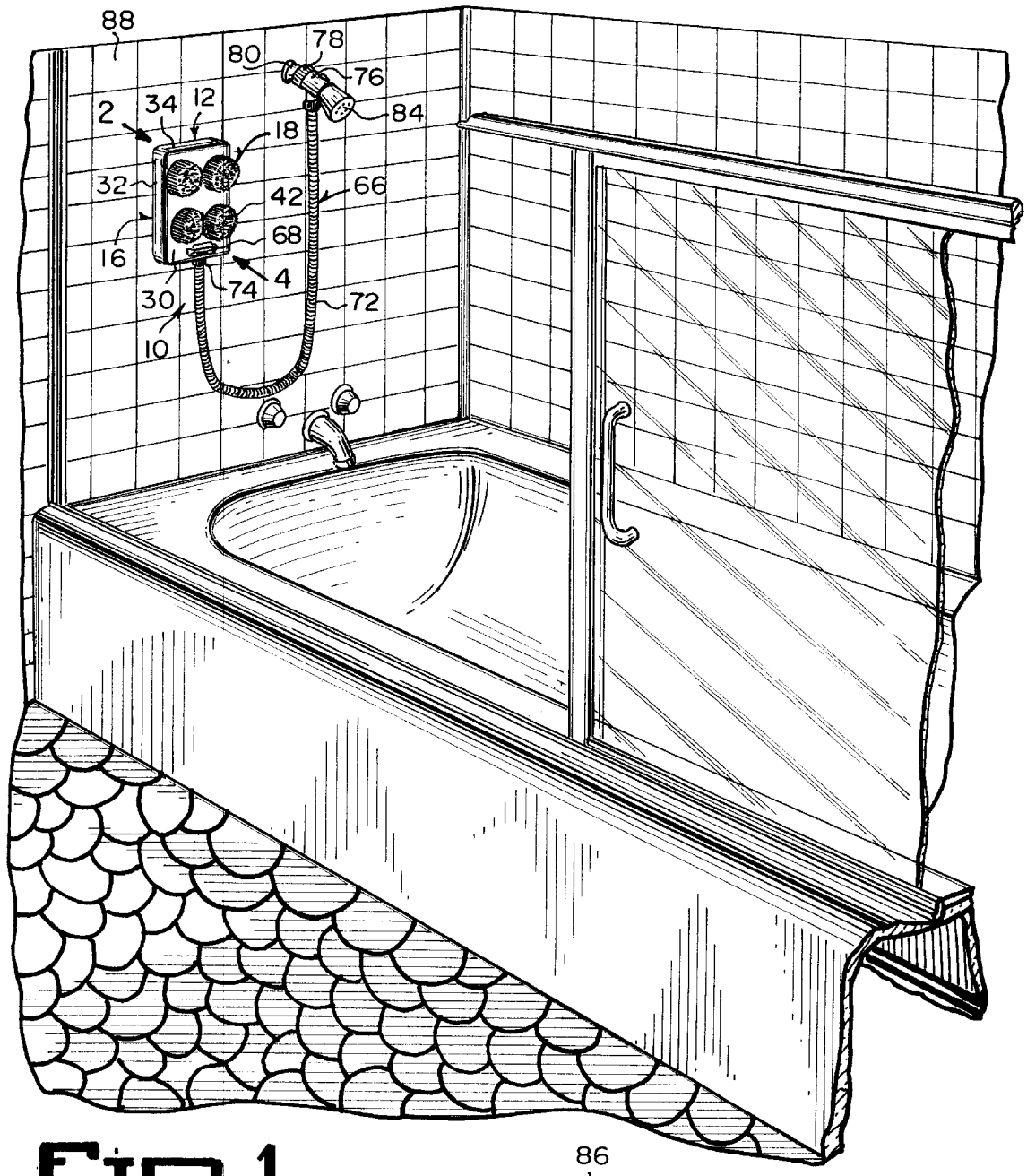
FIG. 1 is a perspective view, showing the instant invention mounted to a shower wall above a bathtub and fluidly connected to a shower head.
Figure 2:
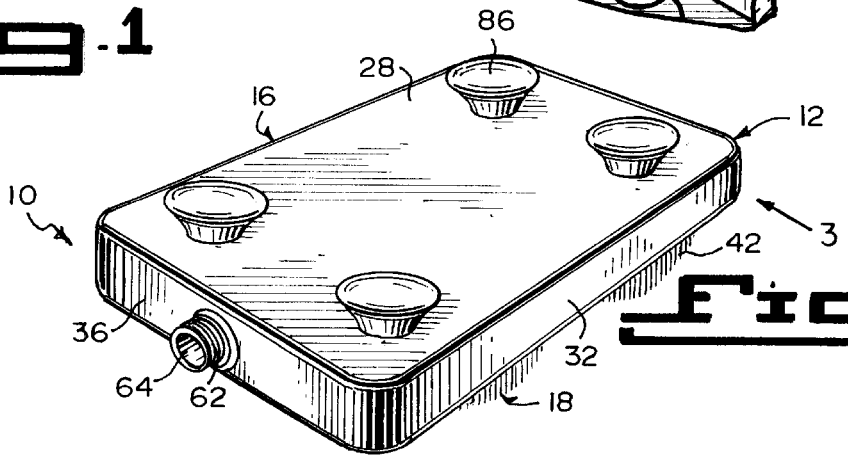
FIG. 2 is an enlarged rear perspective view taken in the direction of arrow 2 in FIG. 1.
Figure 4:
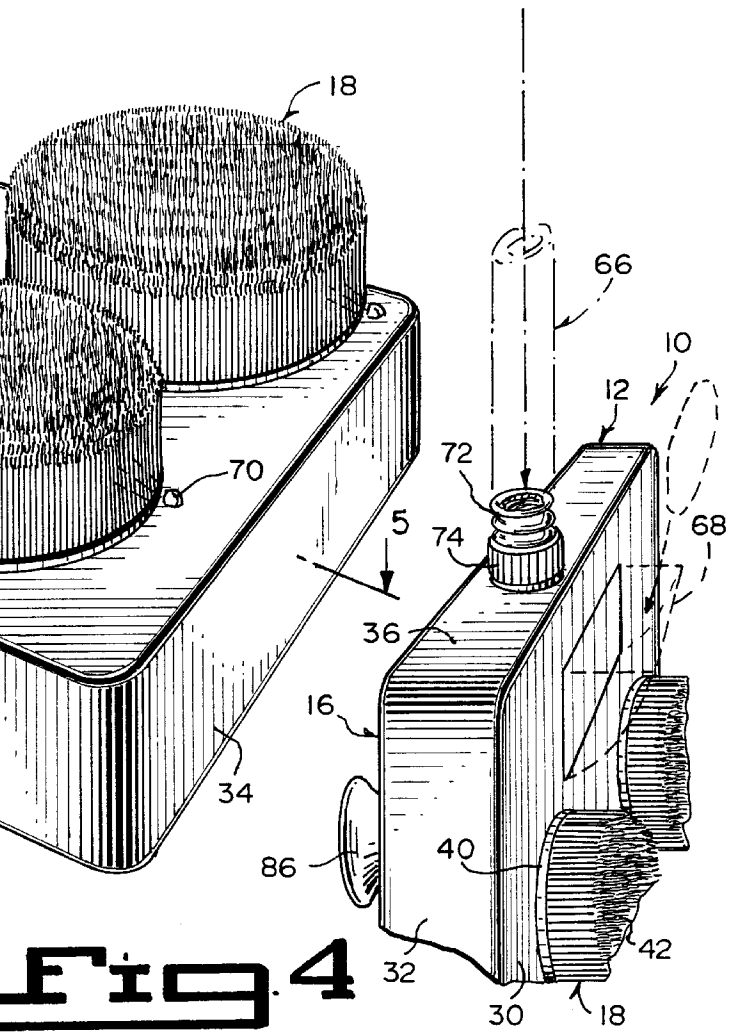
FIG. 4 is a bottom perspective view taken in the direction of arrow 4 in FIG. 1, with parts broken away.
Figure 3:
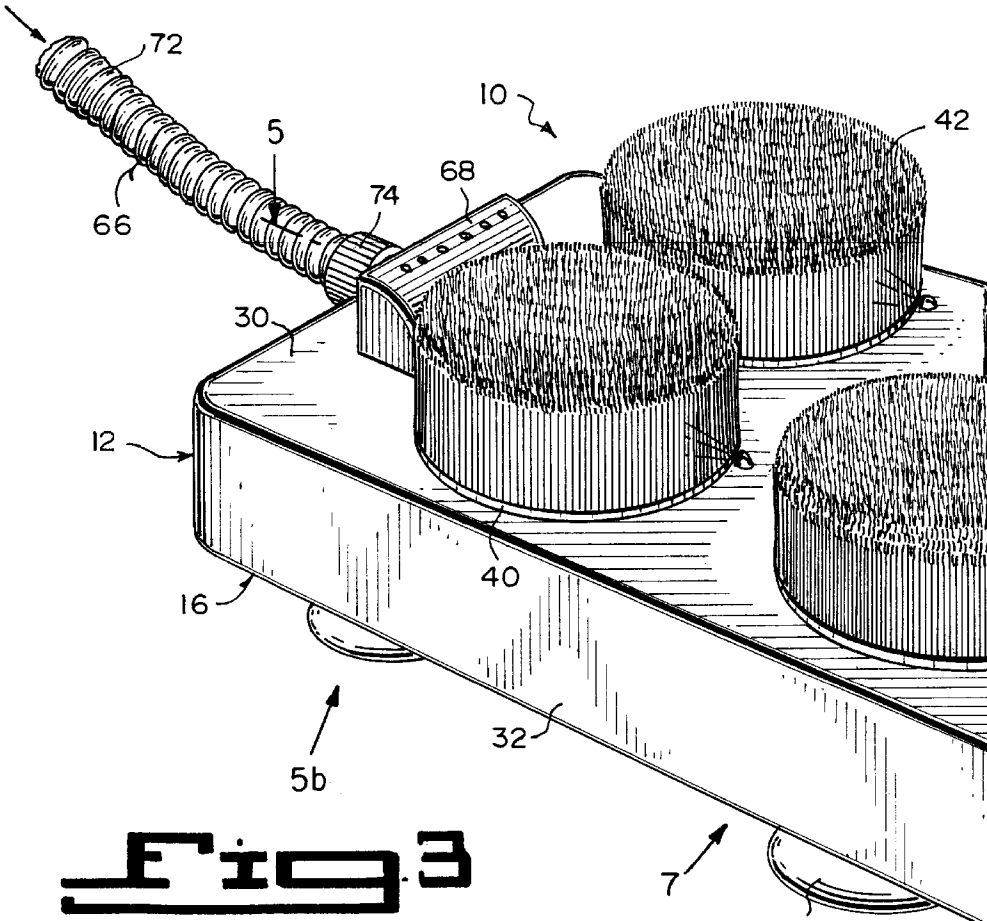
FIG. 3 is a further enlarged front perspective view taken in the direction of arrow 3 in FIG. 2.
Figure 5B:
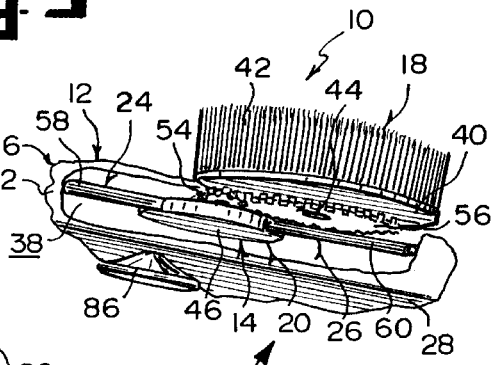

FIG. 5*b* is a bottom perspective view taken in the direction of arrow 5*b* in FIG. 3 with parts broken away, showing the gear assembly of one of the rotary brushes.

Figure 6:
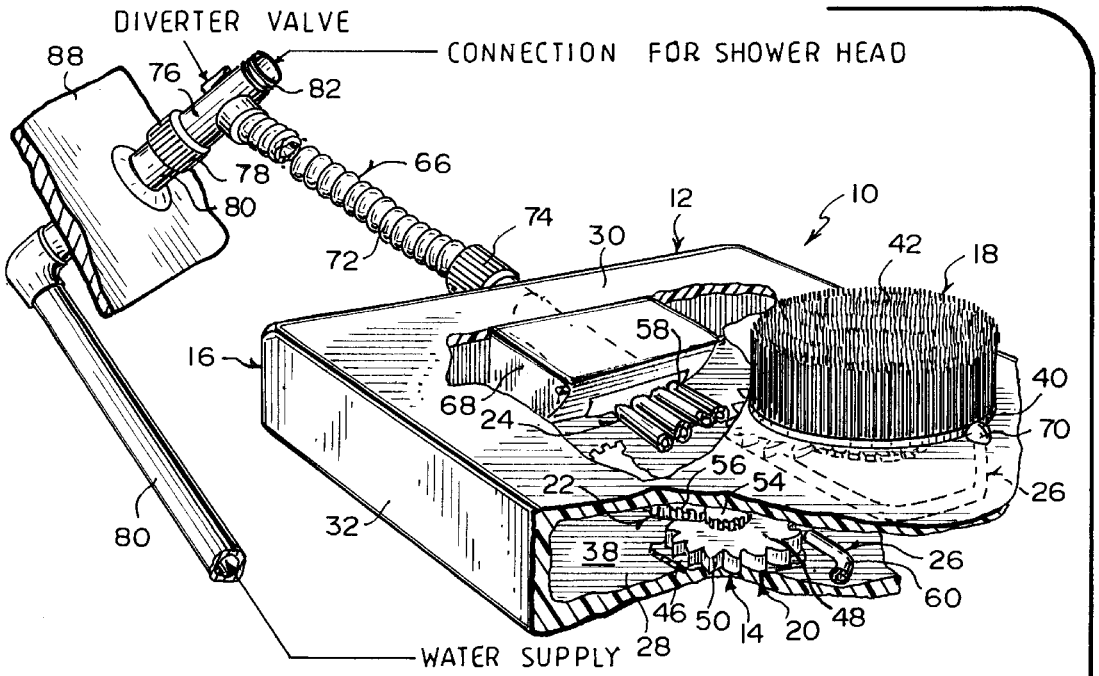

FIG. 6 is a front perspective view with parts broken away and in section, showing various components within the watertight housing and the flexible hose connection for the shower head in greater detail.

Figure 7:
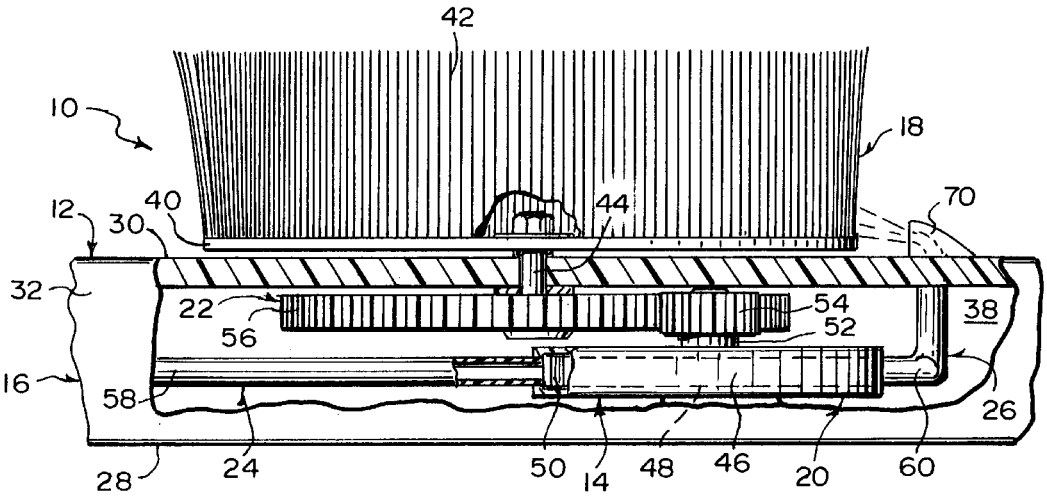

FIG. 7 is a side view taken in the direction of arrow 7 in FIG. 3, with parts broken away and in section.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 7 illustrate a water actuated bath brush 10, comprising a facility 12 for cleaning the skin of a person. A structure 14 is for converting kinetic energy of moving water to mechanical power to operate the skin cleaning facility 12. The cleaning facility 12 includes a watertight housing 16. A plurality of rotary brushes 18 are carried on the housing 16.

The water converting structure 14 consists of a plurality of water turbines 20. Each water turbine 20 is located within the watertight housing 16 below one rotary brush 18. A plurality of gear assemblies 22 are provided. Each gear assembly 22 is operable between one water turbine 20 and one rotary brush 18. A plurality of inlet conduits 24 are also provided. Each inlet conduit 24 conveys water to one water turbine 20. A plurality of outlet conduits 26 are also provided. Each outlet conduit 26 conveys water away from one water turbine 20.

The watertight housing 16 is generally rectangular and comprises a bottom wall 28 and a top wall 30. A pair of long side walls 32 extend between the bottom wall 28 and the top wall 30. A short front wall 34 extends between the bottom wall 28 and the top wall 30. A short rear wall 36 extends between the bottom wall 28 and the top wall 30, so as to form a sealed chamber 38 therein.

Each rotary brush 18 includes a disc shaped base plate 40. A plurality of bristles 42 extend upwardly from the disc shaped base plate 40. A shaft 44 extends downwardly from the center of the disc shaped base plate 42 into the watertight housing 16.

Each water turbine 20 consists of a cylindrical casing 46. A wheel 48 having a plurality of curved teeth 50 rotates within the cylindrical casing 46. A shaft 52 extends centrally from the wheel 48 up through the cylindrical casing 46 to operate one gear assembly 22.

Each gear assembly 22 comprises a small gear 54 operable by one water turbine 20. A large gear 56 is in engagement with the small gear 54, whereby the large gear 56 will rotate one rotary brush 18.

Each water inlet conduit 24 is a first narrow tube 58 fluidly connected to one water turbine 20, to allow water under pressure to enter the water turbine 20. Each water outlet conduit 26 is a second narrow tube 60 fluidly connected to one water turbine 20, to allow water under pressure to exit the water turbine 20.

The water converting structure 14 further includes a connector 62 on the housing 16, having an inlet port 64. The connector 62 is fluidly connected to all of the water inlet conduits 24. An assemblage 66 is connected to the connector 62, for carrying water from a water supply to the water turbines 20. A soap dish 68 is built into the watertight housing 16 and is fluidly connected between the connector 62 and all of the water inlet conduits 24. A plurality of small spray nozzles 70 are provided. Each small spray nozzle 70 is fluidly connected to one water outlet conduit 26 and is mounted on the watertight housing 16 adjacent one rotary brush 18. Each of the small spray nozzles 70 can spray soapy water onto one of the rotary brushes 18.

The water carrying assemblage 66, consists of an accordion type flexible hose 72. A first fitting 74 is on a first end of the flexible hose 72, to engage with the connector 62 on the housing 16. A two-way diverter valve 76 is on a second end of the flexible hose 72. A second fitting 78 on a first end of the diverter valve 76 engages with an end of a shower head water pipe 80. A connector 82 on a second end of the diverter valve 76 engages with a shower head 84. When the diverter valve 76 is manually turned in a first direction, water will exit the shower head 84. When the diverter valve 76 is manually turned in a second opposite direction, water will travel through the flexible hose 72 to all of the water turbines 20. A plurality of suction cups 86 are attached to the back of the watertight housing 16 opposite from the rotary brushes 18, to secure the watertight housing 16 to a shower wall 88 in a stationary manner.

LIST OF REFERENCE NUMBERS

10 water actuated bath brush
12 cleaning facility of 10
14 water converting structure of 10
16 watertight housing of 12
18 rotary brush of 12
20 water turbine of 14
22 gear assembly of 14
24 water inlet conduit of 14
26 water outlet conduit of 14
28 bottom wall of 16
30 top wall of 16
32 long side wall of 16
34 short front wall of 16
36 short rear wall of 16
38 sealed chamber in 16
40 disc shaped base plate of 18
42 bristle of 18
44 shaft of 18
46 cylindrical casing of 20
48 wheel of 20
50 curved teeth on 48
52 shaft on 48
54 small gear of 22
56 large gear of 22
58 first narrow tube for 24
60 second narrow tube for 26
62 connector of 14 on 16
64 inlet port in 62
66 water carrying assemblage of 14
68 soap dish of 14 in 16
70 small spray nozzle of 14
72 accordion type flexible hose of 66
74 first fitting of 66 on 72
76 two-way diverter valve of 66 on 72
78 second fitting of 66 on 76
80 shower head water pipe
82 connector of 66 on 76
84 shower head
86 suction cup on 16
88 shower wall It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A water actuated bath brush comprising:

a) means for cleaning the skin of a person including:
  i) a watertight housing; and
  ii) a plurality of rotary brushes carried on said housing; and b) means for converting kinetic energy of moving water to mechanical power to operate said skin cleaning means including:
  i) a plurality of water turbines, with each said water turbine located within said watertight housing below one said rotary brush;
  ii) a plurality of gear assemblies, with each said gear assembly operable between one said water turbine and one said rotary brush;
  iii) a plurality of inlet conduits, whereby each said inlet conduit conveys water to one said water turbine; and
  iv) a plurality of outlet conduits, whereby each said outlet conduit conveys water away from one said water turbine.

2. A water actuated bath brush as recited in claim 1, wherein said watertight housing is generally rectangular and includes:

a) a bottom wall;
b) a top wall;
c) a pair of long side walls extending between said bottom wall and said top wall;
d) a short front wall extending between said bottom wall and said top wall; and
e) a short rear wall extending between said bottom wall and said top wall, so as to form a sealed chamber therein.

3. A water actuated bath brush as recited in claim 1, wherein each said rotary brush includes:

a) a disc shaped base plate;
b) a plurality of bristles extending upwardly from said disc shaped base plate; and
c) a shaft extending downwardly from the center of said disc shaped base plate into said watertight housing.

4. A water actuated bath brush as recited in claim 1, wherein each said water turbine includes:

a) a cylindrical casing;
b) a wheel having a plurality of curved teeth which rotates within said cylindrical casing; and c) a shaft extending centrally from said wheel up through said cylindrical casing to operate one said gear assembly.

5. A water actuated bath brush as recited in claim 1, wherein each said gear assembly includes:

a) a small gear operable by one said water turbine; and b) a large gear in engagement with said small gear, whereby said large gear will rotate one said rotary brush.

6. A water actuated bath brush as recited in claim 1, wherein each said water inlet conduit is a first narrow tube fluidly connected to one said water turbine, to allow water under pressure to enter said water turbine.

7. A water actuated bath brush as recited in claim 1, wherein each said water outlet conduit is a second narrow tube fluidly connected to one said water turbine, to allow water under pressure to exit said water turbine.

8. A water actuated bath brush as recited in claim 1, wherein said water converting means further includes:

a) a connector on said housing having an inlet port, said connector fluidly connected to all of said water inlet conduits;

b) means connected to said connector for carrying water from a water supply to said water turbines;

c) a soap dish built into said watertight housing and fluidly connected between said connector and all of said water inlet conduits; and d) a plurality of small spray nozzles, each said small spray nozzle fluidly connected to one said water outlet conduit and mounted on said watertight housing adjacent one said rotary brush, so that each of said small spray nozzles can spray soapy water onto one of said rotary brushes.

9. A water actuated bath brush as recited in claim 8, wherein said water carrying means includes:

a) an accordion type flexible hose;

b) a first fitting on a first end of said flexible hose to engage with said connector on said housing;

c) a two-way diverter valve on a second end of said flexible hose;

d) a second fitting on a first end of said diverter valve to engage with an end of a shower head water pipe; and e) a connector on a second end of said diverter valve to engage with a shower head, so that when said diverter valve is manually turned in a first direction, water will exit the shower head and when said diverter valve is manually turned in a second opposite direction, water will travel through said flexible hose to all of said water turbines.

10. A water actuated bath brush as recited in claim 1, further including a plurality of suction cups attached to the back of said watertight housing opposite from said rotary brushes to secure said watertight housing to a shower wall in a stationary manner.

11. A water actuated bath brush comprising:

a) means for cleaning the skin of a person, which includes a watertight housing and a plurality of rotary brushes carried on said housing; and b) means for converting kinetic energy of moving water to mechanical power to operate said skin cleaning means, wherein said water converting means includes:

i) plurality of water turbines, with each said water turbine located within said watertight housing below one said rotary brush;

ii) a plurality of gear assemblies, with each said gear assembly operable between one said water turbine and one said rotary brush;

iii) a plurality of inlet conduits, whereby each said inlet conduit conveys water to one said water turbine; and iv) a plurality of outlet conduits, whereby each said outlet conduit conveys water away from one said water turbine.

12. A water actuated bath brush as recited in claim 11, wherein said watertight housing is generally rectangular and includes:

a) a bottom wall;

b) a top wall;

c) a pair of long side walls extending between said bottom wall and said top wall;

d) a short front wall extending between said bottom wall and said top wall; and e) a short rear wall extending between said bottom wall and said top wall, so as to form a sealed chamber therein.

13. A water actuated bath brush as recited in claim 12, wherein each said rotary brush includes:

a) a disc shaped base plate;

b) a plurality of bristles extending upwardly from said disc shaped base plate; and c) a shaft extending downwardly from the center of said disc shaped base plate into said watertight housing.

14. A water actuated bath brush as recited in claim 13, wherein each said water turbine includes:

a) a cylindrical casing;

b) a wheel having a plurality of curved teeth which rotates within said cylindrical casing; and c) a shaft extending centrally from said wheel up through said cylindrical casing to operate one said gear assembly.

15. A water actuated bath brush as recited in claim 14, wherein each said gear assembly includes:

a) a small gear operable by one said water turbine; and b) a large gear in engagement with said small gear, whereby said large gear will rotate one said rotary brush.

16. A water actuated bath brush as recited in claim 15, wherein each said water inlet conduit is a first narrow tube fluidly connected to one said water turbine, to allow water under pressure to enter said water turbine.

17. A water actuated bath brush as recited in claim 16, wherein each said water outlet conduit is a second narrow tube fluidly connected to one said water turbine, to allow water under pressure to exit said water turbine.

18. A water actuated bath brush as recited in claim 17, wherein said water converting means further includes:

a) a connector on said housing having an inlet port, said connector fluidly connected to all of said water inlet conduits;

b) means connected to said connector for carrying water from a water supply to said water turbines;

c) a soap dish built into said watertight housing and fluidly connected between said connector and all of said water inlet conduits; and d) a plurality of small spray nozzles, each said small spray nozzle fluidly connected to one said water outlet conduit and mounted on said watertight housing adjacent one said rotary brush, so that each of said small spray nozzles can spray soapy water onto one of said rotary brushes.

19. A water actuated bath brush as recited in claim 18, wherein said water carrying means includes:

a) an accordion type flexible hose;

b) a first fitting on a first end of said flexible hose to engage with said connector on said housing;

c) a two-way diverter valve on a second end of said flexible hose;

d) a second fitting on a first end of said diverter valve to engage with an end of a shower head water pipe; and e) a connector on a second end of said diverter valve to engage with a shower head, so that when said diverter valve is manually turned in a first direction, water will exit the shower head and when said diverter valve is manually turned in a second opposite direction, water will travel through said flexible hose to all of said water turbines.

20. A water actuated bath brush as recited in claim 19, further including a plurality of suction cups attached to the back of said watertight housing opposite from said rotary brushes to secure said watertight housing to a shower wall in a stationary manner.

* * * * *